US009845620B2

(12) United States Patent
Bronner

(10) Patent No.: US 9,845,620 B2
(45) Date of Patent: Dec. 19, 2017

(54) DEADBOLT INDICATOR

(71) Applicant: Commercial Door & Hardware, Inc., Colorado Springs, CO (US)

(72) Inventor: Ethan A. Bronner, Colorado Springs, CO (US)

(73) Assignee: COMMERCIAL DOOR & HARDWARE, INC., Colorado Springs, CO (US)

( * ) Notice: Subject to any disclaimer, the term of this patent is extended or adjusted under 35 U.S.C. 154(b) by 0 days.

(21) Appl. No.: 14/604,000

(22) Filed: Jan. 23, 2015

(65) Prior Publication Data

US 2015/0225982 A1 Aug. 13, 2015

Related U.S. Application Data

(60) Provisional application No. 61/938,108, filed on Feb. 10, 2014.

(51) Int. Cl.

| | |
|---|---|
| ***E05B 41/00*** | (2006.01) |
| ***E05B 63/00*** | (2006.01) |
| *E05B 17/22* | (2006.01) |

(52) U.S. Cl.

CPC ..... *E05B 63/0017* (2013.01); *E05B 17/22* (2013.01); *E05B 17/226* (2013.01); *E05B 41/00* (2013.01); *Y10T 70/8027* (2015.04)

(58) Field of Classification Search

CPC ..... E05B 41/00; E05B 17/22; E05B 17/226; E05B 63/0017; Y10T 70/8027

USPC ... 70/432, DIG. 59, 379 R, 379 A, 380, 381, 70/452; 40/460

See application file for complete search history.

(56) References Cited

U.S. PATENT DOCUMENTS

| | | | | | |
|---|---|---|---|---|---|
| 345,339 | A * | 7/1886 | Vail | E05B 41/00 | 40/460 |
| 943,637 | A * | 12/1909 | Schoell | E05B 41/00 | 40/907 |
| 1,294,433 | A * | 2/1919 | Evers | G03B 1/66 | 235/91 C |
| 1,337,401 | A * | 4/1920 | Heberling | E05B 41/00 | 40/460 |
| 1,393,149 | A * | 10/1921 | Matchette | E05B 41/00 | 40/460 |

(Continued)

OTHER PUBLICATIONS

Schlage Lock Company, Installation Instructions for the B571 Thumbturn Deadbolt with Vacancy Indicator lockset, 2007, pp. 1-2.

(Continued)

*Primary Examiner* — Suzanne Barrett
*Assistant Examiner* — Morgan McClure
(74) *Attorney, Agent, or Firm* — Eric W. Cernyar

(57) ABSTRACT

An apparatus for a cylindrical deadbolt assembly indicates whether the deadbolt is locked or unlocked. The apparatus comprises a trim piece, such as an escutcheon or collar, configured to be mounted on the inside face of a door, a dial mounted on an inside surface of the trim piece, and a cam. The trim piece comprises one or more windows for displaying information from the dial. The dial is operative to travel between first and second positions to provide a first indication when the deadbolt is locked and a second indication when the deadbolt is unlocked. The cylinder tail piece turns the cam to move the dial between its first and second positions.

21 Claims, 7 Drawing Sheets

(56) References Cited

U.S. PATENT DOCUMENTS 2,135,322 A * 11/1938 Brantingson ..... E05B 9/084 403/379.4
2,255,402 A * 9/1941 Vile ..... E05B 63/0013 70/139
2,455,208 A * 11/1948 Wirth ..... E05B 41/00 116/282
2,565,669 A * 8/1951 Smith ..... E05B 41/00 116/290
3,006,179 A * 10/1961 Erickson ..... E05B 63/0017 292/140
4,490,999 A * 1/1985 Castle ..... E05B 41/00 70/330
4,559,796 A 12/1985 De Forrest, Sr.
4,683,741 A * 8/1987 Fields ..... E05B 17/10 109/38
4,854,061 A * 8/1989 Khoshkish ..... G09F 11/04 116/204
4,986,576 A * 1/1991 Anderson ..... E05B 35/08 292/40
5,279,422 A * 1/1994 Adams ..... A61J 7/04 116/308
5,586,087 A * 12/1996 Silverson ..... A61J 7/04 206/534
6,938,445 B2 * 9/2005 Huang ..... E05B 41/00 70/107
7,637,227 B2 * 12/2009 Stradella ..... G06M 1/248 116/298
7,866,195 B2 * 1/2011 Levine ..... E05B 41/00 116/80
7,913,437 B2 * 3/2011 Domenig ..... G09F 11/02 116/298
8,037,725 B2 10/2011 Levine
8,105,291 B2 * 1/2012 Silvester ..... A61M 5/1782 604/191
8,281,733 B2 * 10/2012 Kreshek ..... G09F 11/04 116/308
9,021,981 B2 * 5/2015 Raiti de Boyles ..... A61J 7/04 116/308
2002/0095958 A1 7/2002 Bates et al.
2003/0010075 A1 1/2003 Rodriguez
2004/0187533 A1 9/2004 Huang
2006/0144103 A1 7/2006 Blanch
2008/0000277 A1 1/2008 Yu
2008/0145802 A1 6/2008 Hammer et al.
2009/0090148 A1 4/2009 Kollin et al.
2009/0178450 A1 7/2009 Schensky
2010/0313612 A1 12/2010 Eichenstein et al.
2011/0016938 A1 * 1/2011 Chi ..... E05B 41/00 70/432
2011/0100076 A1 5/2011 Weinstein
2014/0311197 A1 * 10/2014 Abel ..... E05B 41/00 70/432

OTHER PUBLICATIONS

Adams Rite, 4089 Exit Indicator specification and installation brochure from Adams Rite catalog, earliest publication date unknown, 2 pages.

* cited by examiner

DEADBOLT INDICATOR

RELATED APPLICATIONS

This application claims the benefit of U.S. Provisional Application No. 61/938,108, filed on Feb. 10, 2014, and entitled "Deadbolt Indicator," which application is hereby incorporated by reference.

FIELD OF INVENTION

This invention relates generally to cylindrical deadbolt assemblies and, more particularly, to providing a visible indication of whether a deadbolt is locked or unlocked.

BACKGROUND

There are two predominant categories of locks: cylindrical locks and mortise locks. Mortise locks were the first type of locksets to be mass produced. A mortise lock comprises a lock box body full of cams and levers. It is expensive to produce. Furthermore, to install a mortise lock, a large amount of material must be cut out of the edge of the door to accept the lock body. This requires special tools and a high skill level.

Early in the twentieth century, Dexter Locks™ introduced a new type of lock that had less complex parts. To mill a door to accept the lock required only drilling a cylindrical hole through the face of the door and drilling another hole from the edge intersecting with the face hole. Since the required preps were cylindrical holes, these locks were called cylindrical locks. From the time of their introduction, the cylindrical lock rapidly grew in popularity. Because of the lower manufacturing cost and sales prices and ease of installation, they became the most popular lock type used. Currently 99 percent of the locks sold in the United States, both in the commercial and residential market, are cylindrical locks.

Deadbolt locks come in both mortise and cylindrical varieties, with the vast majority being cylindrical. There are two basic types of cylindrical deadbolt: the single cylinder deadbolt and the double cylinder deadbolt. The single cylinder deadbolt has a key on the outside and a thumb turn on the inside. A double cylinder deadbolt has a cylinder on both sides and requires a key to lock or unlock the deadbolt from either side of the door.

Contemporary building and fire codes do not allow cylinder deadbolts on doors in a path of egress (the path of exit) unless the locking device is readily distinguishable as locked and a readily visible, durable sign is posted on the egress side on or adjacent to the door stating: "THIS DOOR TO REMAIN UNLOCKED WHEN BUILDING IS OCCUPIED."

The predominant indicator available in the market today is the Adams Rite™ indicator. However, it only works in conjunction with mortise locks. The use of the Adams Rite™ indicator requires special milling and mortising of a door that is not common in either the residential or the commercial door marketplace.

Applicant is unaware of any indicator deadbolt that fits the code requirements and fits the most common lock prep, the cylindrical lock. If a door has been machined for a cylindrical lock, then the Adams Rite™ lock cannot be installed without great expense or rework to the door. So, if a door has been machined for a cylindrical deadbolt and is in the path of egress, there are currently no locks or solutions that will allow the door owner to meet the egress codes without encountering great expense.

Contractors frequently fail their final fire inspection for having a deadbolt that does not meet the code requirements for lack of an indicator. They are faced with replacing the door or having it patched and remachined for the Adams Rite™ indicator or simply removing the deadbolt. In most cases the deadbolt was installed because the added security was needed. Removal opens up the end user to more liability and possible theft. The most common resolution to this dilemma is for the contractor to remove the deadbolt and put a filler plate into the hole left by the deadbolt. They pass their inspection and tell the owner they are not allowed to have a deadbolt on the door by code, but if they want it they can install it themselves when the contractor is done with the project. Frequently, the building owner will reinstall the deadbolt even though it is in violation of life safety codes and is unsafe.

SUMMARY

Indicators are provided for a cylindrical cylinder deadbolt. In one embodiment, the indicator fits the industry standard cylindrical lock prep and does not require any extra machining of the door. The indicator works via a cam inside that shares the cam on the back of the cylinder and turns as the key is turned on the deadbolt. The cam turns a dial that is marked LOCKED or OPEN, IN USE or OPEN, or with some other suitable indications.

In another embodiment, the indicator is built into the deadbolt itself, with the holes and LOCKED or OPEN showing on the housing body of the deadbolt.

In yet another embodiment, an indicator is provided for a single cylinder deadbolt that is not on an exit door. For instance, the indicator may be used on a single stall bathroom door with a single cylinder deadbolt that has a thumb turn on the inside and a cylinder on the outside. This shows the occupied status of a room. Unlike privacy indicator deadbolts available for bathrooms, this apparatus locks from the outside of the room. Also, unlike typical privacy indicator deadbolts that only require a flat object such as a bobby pin to unlock from the secure side, this apparatus prevents unlocking of the deadbolt from the secure side without a key. Installed on a single stall restroom with push pulls, the apparatus acts as a securing device for privacy, but also allows the owners to lock down the restroom when they do not want to allow access because of needed repair or cleaning.

These and other objects, features, and advantages of the present invention will be readily apparent to those skilled in the art from the following detailed description taken in conjunction with the annexed sheets of drawings, which illustrate the invention.

DETAILED DESCRIPTION

Figure 1:
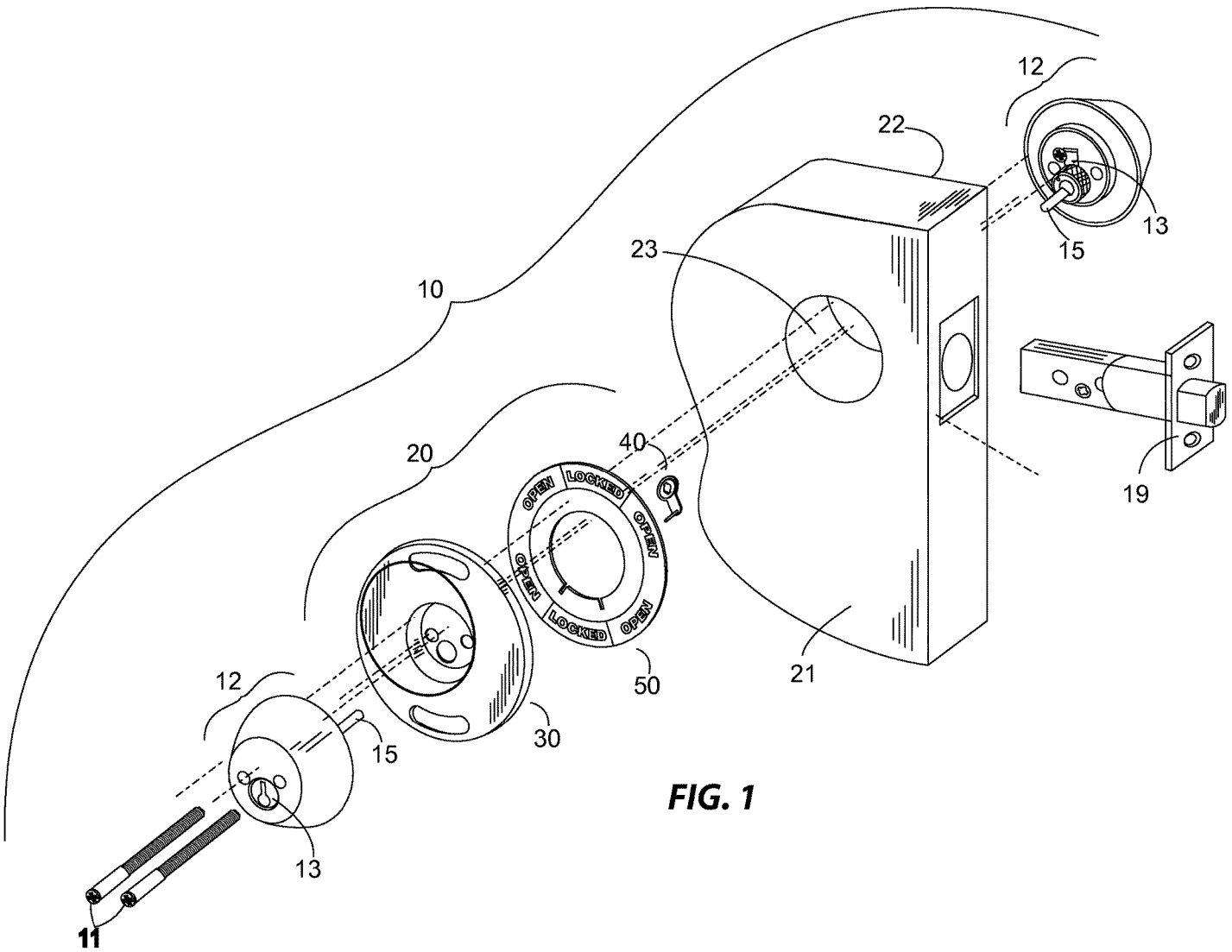
FIG. 1 is an exploded view diagram of one embodiment of a cylindrical deadbolt assembly with a deadbolt indicator escutcheon apparatus.
Figure 2:
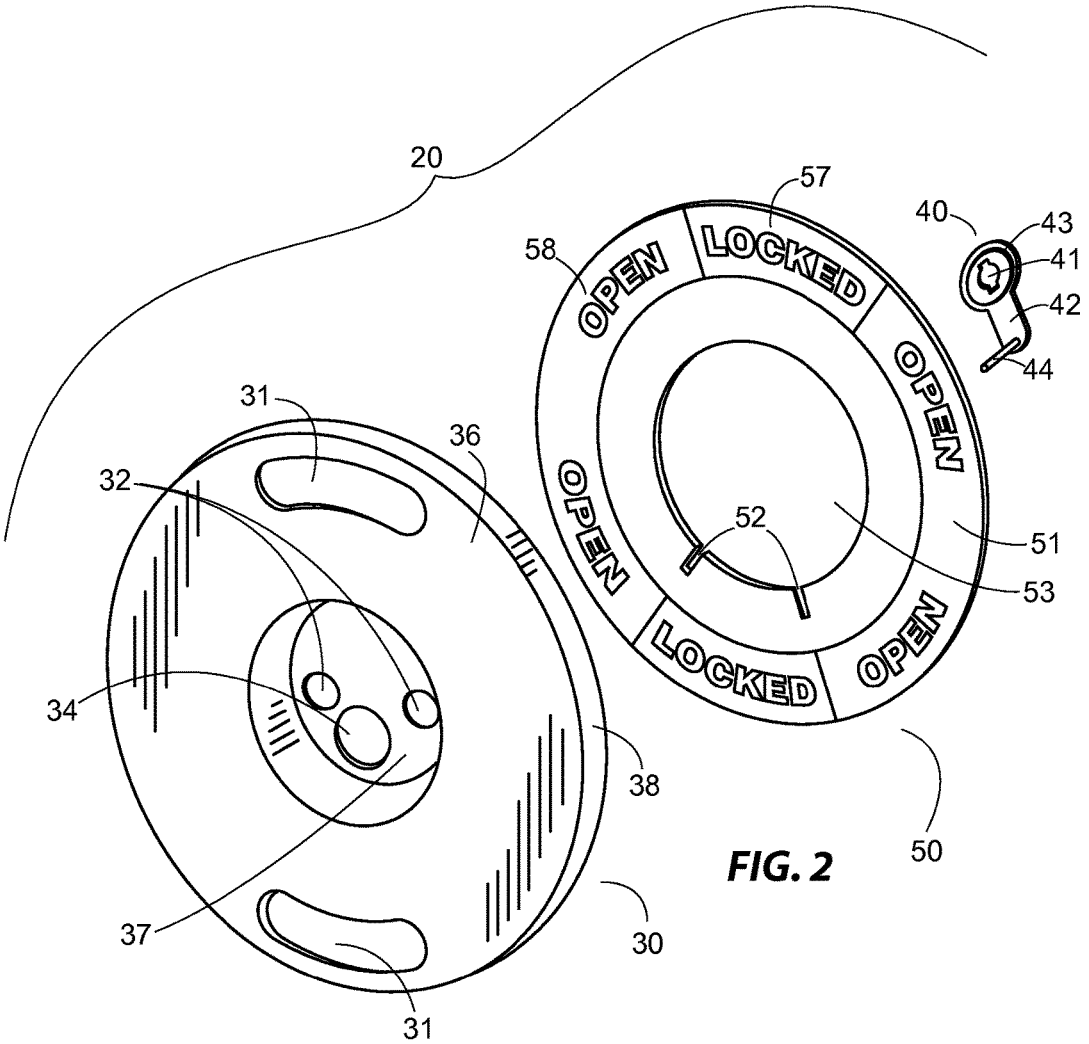
FIG. 2 is an exploded front view diagram of the deadbolt indicator escutcheon apparatus of FIG. 1.
Figure 3:
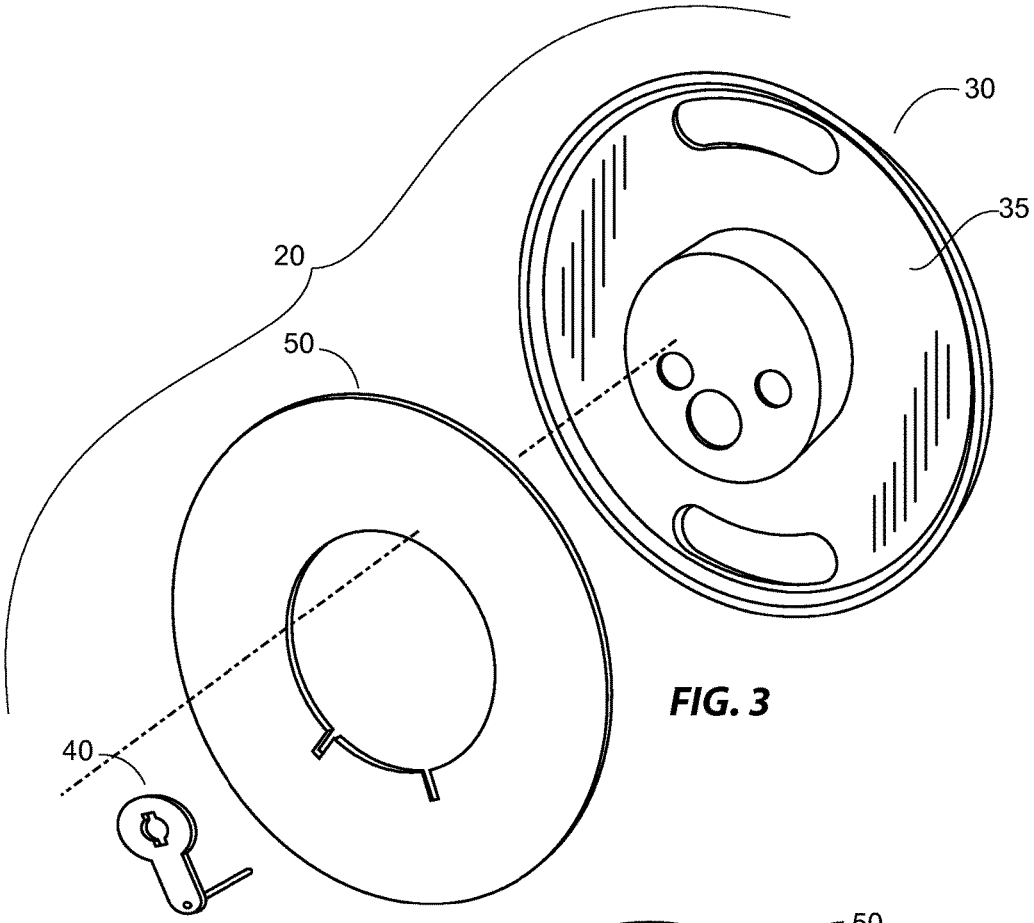
FIG. 3 is an exploded rear view diagram of the deadbolt indicator escutcheon apparatus of FIG. 1.
Figure 4:
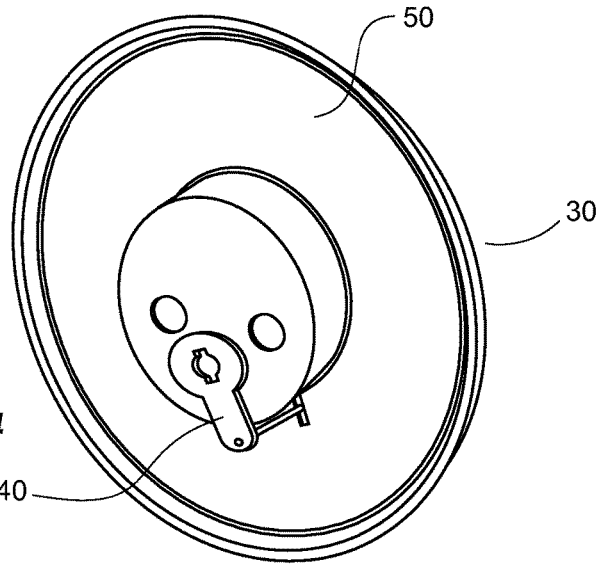
FIG. 4 is a rear perspective view of the deadbolt indicator escutcheon apparatus of FIG. 3 in an assembled state, illustrating an indicator and cam mounted to the escutcheon, wherein the cam is configured to be turned by a cylinder tail piece to move the indicator between first and second positions.
Figure 5:
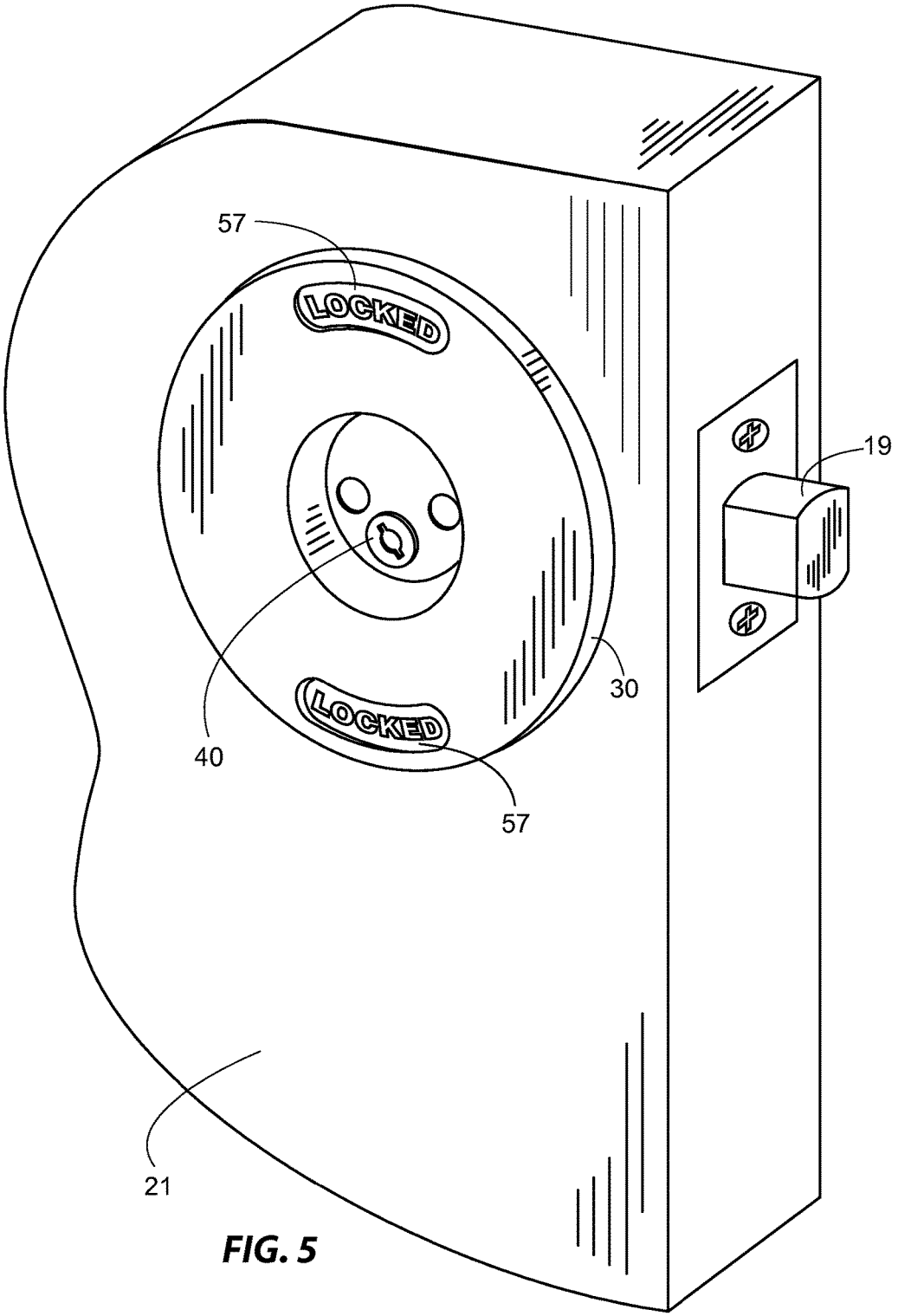
FIG. 5 illustrates the deadbolt indicator escutcheon apparatus seated within the cylindrical bore of a door, displaying the word "LOCKED" to indicate that the door is locked.
Figure 6:
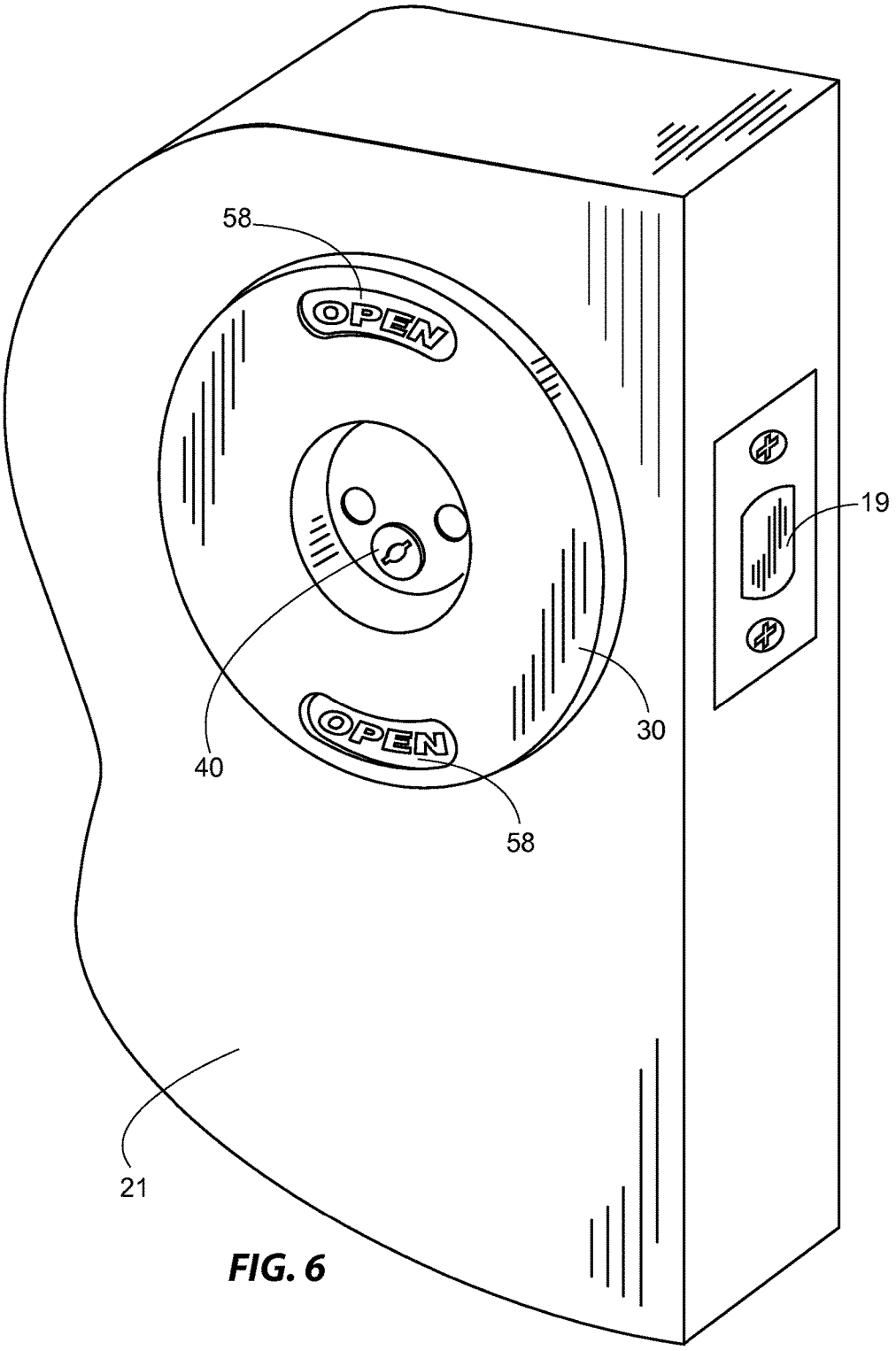
FIG. 6 illustrates the deadbolt indicator escutcheon apparatus seated within the cylindrical bore of a door, displaying the word "OPEN" to indicate that the door is unlocked.

Before the subject invention is described further, it is to be understood that the invention is not limited to the particular embodiments of the invention described below or depicted in the drawings. Many modifications may be made to adapt or modify a depicted embodiment without departing from the objective, spirit and scope of the present invention. Therefore, it should be understood that, unless otherwise specified, this invention is not to be limited to the specific details shown and described herein, and all such modifications are intended to be within the scope of the claims made herein.

It is also to be understood that terms of art and words in general carry a range of meanings. Language is an imprecise medium of communication. The terminology and grammar employed in this specification is for the purpose of describing and explicating particular embodiments. Unless the context clearly demonstrates otherwise, the particular terms and grammatical structure employed should be liberally construed.

FIGS. 1-8 illustrate three embodiments of an apparatus 20 for indicating the setting of a cylindrical deadbolt assembly 10 having at least one keyed cylinder assembly 12 operable to turn a cylinder tail piece 15 to operate a bolt assembly 19. In FIGS. 1-6, the apparatus 20 comprises an escutcheon 30 configured to mount on the inside face of a door 21 and an indicator 50 mounted on an inside surface 35 of the escutcheon 30. The escutcheon 30 comprises one or more windows 31 for displaying information from the indicator 50. The indicator 50 is operative to travel between first and second positions to provide a first indication 57 when the deadbolt is locked and a second indication 58 when the deadbolt is unlocked. The apparatus 20 also comprises a mechanical coupling 40, such as a cam, configured to be turned by the cylinder tail piece 15 to move the indicator 50 between its first and second positions.

The indicator 50 comprises a ring 51 with first and second indications 57 and 58 that are angularly spaced from one another. The ring 51 has a central opening 53, and at least one slot 52 is provided along the perimeter of a central opening 53. The ring 51 is mechanically coupled to the cylinder tail piece 15 through at least one slot 52. In one embodiment, dual slots 52 are provided along this perimeter, and the ring is mechanically coupled 40 to the cylinder tail piece 15 through a selected one of the dual slots 52 depending on whether the door is a right-handed or left-handed door.

The cam 40 comprises a mechanical coupling configured to move (rotate) the indicator 50 between its first and second positions. The mechanical coupling comprises a hub 43 and a link 44 (such as a pin) rigidly coupled to the hub 43 via a radially distal portion 42 (such as an arm) of the hub 43. The hub 43 is configured with an aperture 41 through which the cylinder tail piece 15 is inserted to mount the cam 40 on the cylinder tail piece 15. The link 44 is configured to fit within a slot 52 of the ring 51.

The escutcheon 30 is configured to facilitate movement of the indicator 50 between its first and second indications 57 and 58. In particular, the escutcheon 30 comprises an outer lip 38 that contacts the inside face of the door 21, a cylindrical shaped central portion 37 configured to extend into the cylindrical bore 23 of the door 21, and a seat 36 between the cylindrically shaped central portion 37 and the outer lip 38. The seat 36, spaced apart by the outer lip 38 from the door 21, provides a space for angular travel of the indicator 50 between its first and second positions.

To prevent the escutcheon 30 from rotating, first and second apertures 32 are provided to receive mounting screws 11 of the deadbolt assembly 12. A third aperture 34 is provided for passage therethrough of the cylinder tail piece 15.

Figure 7:
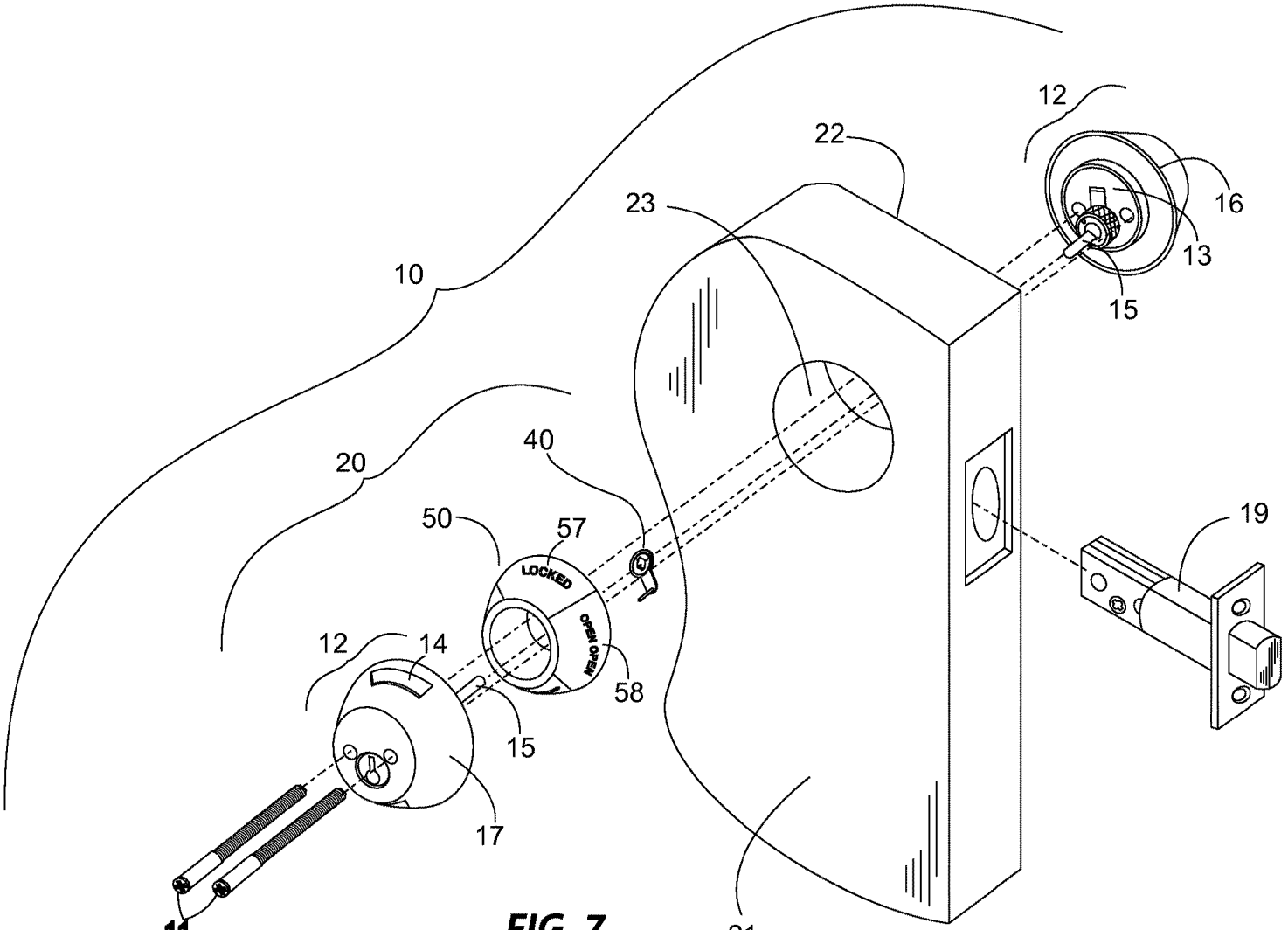
FIG. 7 is an exploded view diagram of another embodiment of a cylindrical deadbolt assembly with a deadbolt indicator, suitable for use in indicating whether a restroom is occupied.

In FIG. 7, the apparatus 20 comprises an inside collar 12 configured to mount on the inside face of a door 21 and an indicator 50 mounted on an inside surface of the inside collar 12. The indicator 50 comprises a rotary member having first second indications 57 and 58 that are angularly spaced from one another. The inside collar 12 comprises one or more windows 14 for displaying information from the indicator 50. The inside collar 12 comprises an outer lip 16 configured to contact the inside face of the door 21, a cylindrical shaped central portion 13 configured to extend into the cylindrical bore of the door 23, and a seat 17 between the cylindrically shaped central portion 13 and the outer lip 16, the seat 17 facilitating angular movement of the indicator 50 between its first and second positions. In most other details, the apparatus of FIG. 7 is the same as the apparatus of FIG. 1.

Figure 8:
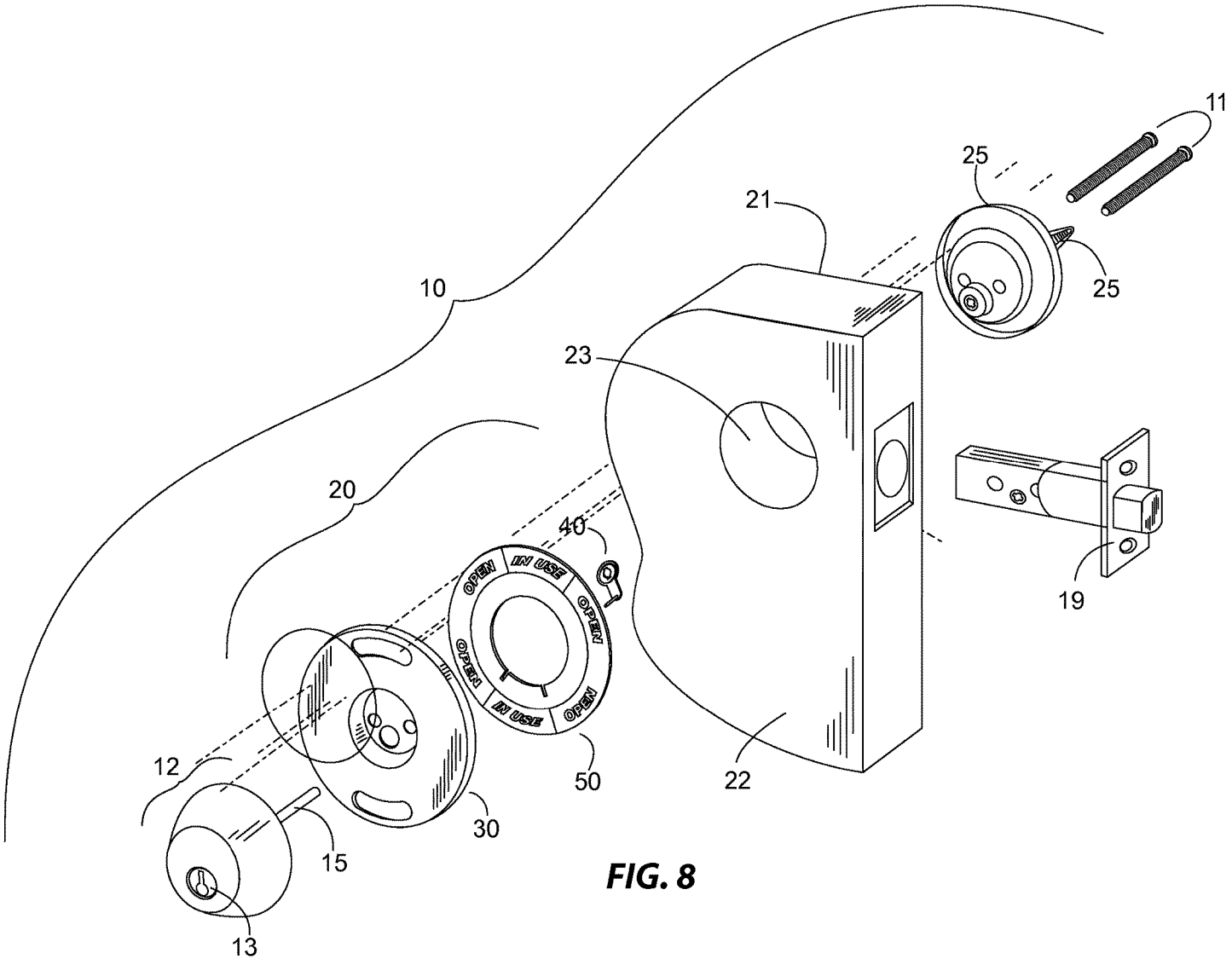
FIG. 8 is an exploded view diagram of a third embodiment of a cylindrical deadbolt assembly with a deadbolt indicator.

In FIG. 8, the apparatus comprises a single cylinder deadbolt assembly with a thumbturn 25 for a non-exit door. It is apparent from the drawing that in most details, FIG. 8 is the same as the apparatus of FIG. 1, but with the indicator 50 labeled with "OPEN" and "IN USE" or similar indications for use on the outside face of a door 22.

The invention encompasses not only indicators made for pre-existing cylindrical deadbolt assemblies, but also cylindrical deadbolt assemblies that include indicators. Accordingly, in one embodiment, a cylindrical deadbolt assembly is provided that comprises a bolt assembly, at least one keyed cylinder assembly operable to turn a cylinder tail piece to operate the bolt assembly, a trim piece configured to mount on the inside face of a door, and an indicator mounted on an inside surface of the trim piece. The indicator is operative to travel between first and second positions to provide a first indication when the deadbolt is locked and a second indication when the deadbolt is unlocked.

Although the foregoing specific details describe various embodiments of the invention, persons reasonably skilled in the art will recognize that various changes may be made in the details of the apparatus of this invention without departing from the spirit and scope of the invention as defined in the appended claims.

I claim:

1. An apparatus for indicating the setting of a cylindrical deadbolt assembly on a door having a keyed cylinder assembly mounted in a substantially coaxial arrangement with a cylindrical bore of the door and operable to turn an axially oriented cylinder tail piece that extends into the door bore to operate a bolt assembly, the apparatus comprising:

an escutcheon configured to mount between the door and the keyed cylinder assembly, the escutcheon comprising an exterior section and a cylindrical interior section having a cylindrical axis, wherein the exterior section is configured to be mounted to the door's exterior surrounding the door bore, and the cylindrical interior section is configured to extend about the cylindrical axis from the exterior section into the door bore;

a rotary indicator mounted on an inside surface of the exterior section of the escutcheon, the indicator being operative to rotate between first and second positions to provide a first indication when the deadbolt assembly is locked and a second indication when the deadbolt assembly is unlocked; and a mechanical coupling configured to rotate the indicator between its first and second positions, the mechanical coupling comprising a hub and a link rigidly connected to the hub, wherein:

the hub is configured to be mounted inside the door bore, adjacent a base of the cylindrical interior section opposite the exterior section, and to receive and be turned by the cylinder tail piece, wherein the hub includes a distal portion that extends in a radial direction beyond boundaries of the cylindrical interior section; and the link projects perpendicularly from the distal portion of the hub so that upon assembly of the mechanical coupling to the indicator and escutcheon, the link extends from the hub to the indicator in a direction parallel to the cylindrical axis of the escutcheon's cylindrical interior section;

wherein the configuration of the hub, link and indicator configures them to be positioned exclusively within and about the cylindrical door bore, without traversing through any other cuts to the door, thereby enabling the apparatus to be installed in a door, which has only a single cylindrical bore for receiving a key cylinder, without making new preparatory cuts in the door.

2. The apparatus of claim 1, wherein the indicator comprises a ring, the first and second indications are angularly distributed from one another, and the mechanical coupling is configured to rotate the ring between its first and second positions.

3. The apparatus of claim 2, wherein the ring has a central opening, a slot is provided along the perimeter of a central opening, and the ring is mechanically coupled to the cylinder tail piece through the slot.

4. The apparatus of claim 1, wherein the hub is configured with an aperture through which the cylinder tail piece is inserted to mount the hub on the cylinder tail piece.

5. The apparatus of claim 4, wherein the indicator comprises a ring, and the link consists essentially of a pin carried by the distal portion of the hub, the pin configured to fit within a slot of the ring.

6. The apparatus of claim 1, wherein the escutcheon comprises one or more windows for displaying information from the indicator.

7. The apparatus of claim 1, wherein the escutcheon comprises an outer lip configured to contact the inside face of the door, a cylindrical shaped central portion configured to extend into the cylindrical bore of the door, and a seat between the cylindrically shaped central portion and the outer lip, the seat facilitating rotation of the indicator between its first and second positions.

8. The apparatus of claim 1, wherein the escutcheon comprises first and second apertures for receiving mounting screws of the deadbolt assembly and a third aperture for passage therethrough of the cylinder tail piece.

9. The apparatus of claim 1, wherein the link is linear.

10. The apparatus of claim 9, wherein the hub, including the distal portion, is flat.

11. The apparatus of claim 10, wherein the link is perpendicular to the hub.

12. An apparatus for indicating the setting of a cylindrical deadbolt assembly on a door having a keyed cylinder assembly mounted in a substantially coaxial arrangement with a bore of the door and operable to turn an axially oriented cylinder tail piece that extends into the door bore to operate a bolt assembly, the apparatus comprising:

an escutcheon configured to mount between the door and the keyed cylinder assembly, the escutcheon comprising an exterior section and an interior section, wherein the exterior section is configured to be mounted to the door's exterior surrounding the door bore, and the interior section is axially displaced from the exterior section so as to extend into the door bore;

an indicator mounted on an inside surface of the exterior section of the escutcheon, the indicator being operative to travel between first and second positions to provide a first indication when the deadbolt assembly is locked and a second indication when the deadbolt assembly is unlocked; and a mechanical coupling configured to rotate the indicator between its first and second positions, the mechanical coupling comprising a hub and a link, wherein:

the hub is configured to be mounted inside the door bore, adjacent a side of the interior section opposite the exterior section, and to receive and be turned by the cylinder tail piece, wherein the hub includes a distal portion that extends in a radial direction beyond boundaries of the interior section; and upon mounting to a door, the link extends at an angle from the distal portion of the hub, which is axially displaced from the indicator, toward the indicator;

wherein the indicator comprises a ring, the first and second indications are angularly distributed from one another, and the mechanical coupling is configured to rotate the ring between its first and second positions;

wherein the ring has a central opening, dual slots are provided along the perimeter of a central opening, and the ring is mechanically coupled to the cylinder tail piece through a selected one of the dual slots depending on whether the door is a right-handed or left-handed door.

13. An apparatus for indicating the setting of a cylindrical deadbolt assembly on a door having a keyed cylinder assembly mounted in a substantially coaxial relationship with a cylindrical bore of the door and operable to turn an axially oriented cylinder tail piece that extends into the door bore to operate a bolt assembly, the apparatus comprising:

an inside collar configured to mount between the door and the keyed cylinder assembly, the inside collar comprising an exterior section and a cylindrical interior section having a cylindrical axis, wherein the exterior section is configured to be mounted to the door's exterior surrounding the door bore, and the cylindrical interior section is configured to extend about the cylindrical axis from the exterior section into the door bore;

a rotary indicator mounted on an inside surface of the exterior section of the inside collar, the indicator being operative to rotate between first and second positions to provide a first indication when the deadbolt assembly is locked and a second indication when the deadbolt assembly is unlocked; and a mechanical coupling configured to rotate the indicator between its first and second positions, the mechanical coupling comprising a hub and a link rigidly connected to the hub, wherein:

the hub is configured to be mounted adjacent a base of the cylindrical interior section opposite the exterior section, and to receive and be turned by the cylinder tail piece, wherein the hub includes a distal portion that extends in a radial direction beyond boundaries of the cylindrical interior section; and the link projects perpendicularly from the distal portion of the hub so that upon assembly of the mechanical coupling to the rotary indicator and inside collar, the link extends from the hub to the indicator in a direction parallel to the cylindrical axis of the escutcheon's cylindrical interior section;

wherein the configuration of the hub, link and indicator configures them to be positioned exclusively within and about the cylindrical door bore, without traversing through any other cuts to the door, thereby enabling the apparatus to be installed in a door, which has only a single cylindrical bore for receiving a key cylinder, without making new preparatory cuts in the door.

14. The apparatus of claim 13, wherein the indicator comprises a rotary member, the first and second indications are angularly distributed from one another, and the mechanical coupling is configured to rotate the rotary member between its first and second positions.

15. The apparatus of claim 14, wherein the rotary member has a central opening, a slot is provided along the perimeter of a central opening, and the rotary member is mechanically coupled to the cylinder tail piece through the slot.

16. The apparatus of claim 13, wherein the hub is configured with an aperture through which the cylinder tail piece is inserted to mount the mechanical coupling on the cylinder tail piece.

17. The apparatus of claim 16, wherein the indicator comprises a rotary member, and the link consists essentially of a pin carried by an arm coupled to the hub, the pin configured to fit within a slot of the rotary member.

18. The apparatus of claim 13, wherein the inside collar provides one or more windows for displaying information from the indicator.

19. The apparatus of claim 13, wherein the inside collar comprises an outer lip configured to contact the inside face of the door and a seat between the cylindrical interior section of the inside collar and the outer lip, the seat facilitating rotation of the indicator between its first and second positions.

20. A cylindrical deadbolt assembly comprising:

a bolt assembly;

a keyed cylinder assembly mounted in a substantially coaxial arrangement with a cylindrical bore of a door and operable to turn an axially oriented cylinder tail piece that extends into the door bore to operate the bolt assembly;

an escutcheon configured to mount between the door and the keyed cylinder assembly, the escutcheon comprising an exterior section and an interior section, wherein the exterior section is configured to be mounted to the door's exterior surrounding the door bore, and the interior section is displaced from the exterior section about an axis of the interior section so as to extend into the door bore;

an indicator mounted on an inside surface of the exterior section of the escutcheon, the indicator being operative to travel between first and second positions to provide a first indication when the deadbolt assembly is locked and a second indication when the deadbolt assembly is unlocked; and a mechanical coupling configured to move the indicator between its first and second positions, the mechanical coupling comprising a hub and a link rigidly connected to the hub, wherein:

the hub is configured to be mounted inside the door bore, adjacent a base of the interior section opposite the exterior section, and to receive and be turned by the cylinder tail piece, wherein the hub includes a distal portion that extends in a radial direction beyond boundaries of the interior section; and the link projects perpendicularly from the distal portion of the hub so that upon assembly of the mechanical coupling to the indicator and escutcheon, the link extends from the hub to the indicator in a direction parallel to the cylindrical axis of the escutcheon's cylindrical interior section;

wherein the configuration of the hub, link and indicator configures them to be positioned exclusively within and about the cylindrical door bore, without traversing through any other cuts to the door, thereby enabling the apparatus to be installed in a door, which has only a single cylindrical bore for receiving a key cylinder, without making new preparatory cuts in the door.

21. An apparatus for indicating the setting of a cylindrical deadbolt assembly on a door having a keyed cylinder assembly mounted in a substantially coaxial relationship with a bore of the door and operable to turn an axially oriented cylinder tail piece that extends into the door bore to operate a bolt assembly, the apparatus comprising:

an inside collar configured to mount between the door and the keyed cylinder assembly, the inside collar having an exterior section and an interior section, wherein the exterior section is configured to be mounted to the door's exterior surrounding the door bore, and the interior section extends in an axial direction from the exterior section into the door bore;

an indicator mounted on an inside surface of the exterior section of the inside collar, the indicator being operative to travel between first and second positions to provide a first indication when the deadbolt assembly is locked and a second indication when the deadbolt assembly is unlocked; and a mechanical coupling configured to rotate the indicator between its first and second positions, the mechanical coupling comprising a hub and a link, wherein:

the hub is configured to be mounted adjacent a side of the interior section opposite the exterior section, and to receive and be turned by the cylinder tail piece, wherein the hub includes a distal portion that extends in a radial direction beyond boundaries of the interior section; and upon mounting to a door, the link extends from the distal portion of the hub, which is axially displaced from the indicator, toward the indicator;

wherein the indicator comprises a rotary member, the first and second indications are angularly distributed from one another, and the mechanical coupling is configured to rotate the rotary member between its first and second positions;

wherein the rotary member has a central opening, dual slots are provided along the perimeter of a central opening, and the rotary member is mechanically coupled to the cylinder tail piece through a selected one of the dual slots depending on whether the door is a right-handed or left-handed door.

* * * * *